US008899509B2

(12) United States Patent
Hjort et al.

(10) Patent No.: US 8,899,509 B2
(45) Date of Patent: Dec. 2, 2014

(54) DISPENSER FOR A ROLL OF ABSORBENT PAPER TISSUE OR NONWOVEN MATERIAL

(75) Inventors: Erik Hjort, Borlänge (SE); Mats Lind, Vikmanshyttan (SE); Joakim Norin, Hägersten (SE); Marcus Kullman, Borlänge (SE); Ingemar Ekmefjord, Vikmanshyttan (SE)

(73) Assignee: SCA Hygiene Products AB, Goteborg (SE)

( * ) Notice: Subject to any disclaimer, the term of this patent is extended or adjusted under 35 U.S.C. 154(b) by 0 days.

(21) Appl. No.: 13/700,320

(22) PCT Filed: May 27, 2010

(86) PCT No.: PCT/SE2010/050576

§ 371 (c)(1), (2), (4) Date: Dec. 17, 2012

(87) PCT Pub. No.: WO2011/149395

PCT Pub. Date: Dec. 1, 2011

(65) Prior Publication Data

US 2013/0105618 A1 May 2, 2013

(51) Int. Cl.

| | |
|---|---|
| ***B65H 16/06*** | (2006.01) |
| ***A47K 10/38*** | (2006.01) |
| *A47K 10/32* | (2006.01) |

(52) U.S. Cl.

CPC ..... *A47K 10/38* (2013.01); *A47K 2010/3233* (2013.01)

USPC ..... 242/588.6; 242/598.3

(58) Field of Classification Search

CPC ..... B65H 16/02; B65H 16/06; B65H 75/08; B65H 2301/41344; B65H 2301/4134; B65H 2301/41342; B65H 2301/4135; B65H 2301/41352

USPC ..... 242/588, 588.3, 588.6, 598.3, 598.4, 242/598.5, 598.6, 599, 599.2, 599.3, 422.4

See application file for complete search history.

(56) References Cited

U.S. PATENT DOCUMENTS

| | | | | |
|---|---|---|---|---|
| 3,062,606 | A | 11/1962 | Magrauth | |
| 3,335,973 | A | 8/1967 | Genn | |
| 4,444,359 | A | 4/1984 | Butler | |
| 7,168,650 | B2 * | 1/2007 | Inana et al. | 242/348 |
| 7,866,593 | B2 * | 1/2011 | Friesen et al. | 242/560 |
| 8,464,976 | B2 * | 6/2013 | Mok et al. | 242/564.4 |
| 2005/0230514 | A1 * | 10/2005 | Inana et al. | 242/423.2 |
| 2011/0168831 | A1 * | 7/2011 | Mok et al. | 242/564.4 |

OTHER PUBLICATIONS

International Search Report (PCT/ISA/210) issued on Feb. 2, 2011, by the Swedish Patent Office as the International Searching Authority for International Application No. PCT/SE2010/050576.

Written Opinion (PCT/ISA/237) issued on Feb. 2, 2011, by the Swedish Patent Office as the International Searching Authority for International Application No. PCT/SE2010/050576.

* cited by examiner

*Primary Examiner* — William A Rivera

(74) *Attorney, Agent, or Firm* — Buchanan Ingersoll & Rooney PC

(57) ABSTRACT

A device dispenser for a roll of absorbent paper, tissue or nonwoven material is provided. The dispenser has a housing with a first wall provided with a dispensing opening and a movable housing portion, which movable housing portion in an open position allows the dispenser to be refilled. The dispenser has a suspension arrangement for the roll and in which the roll is rotatable. The suspension arrangement is arranged to bias the roll towards the dispensing opening in a dispensing position when the movable housing portion is in a closed position. The suspension arrangement is connected to a pull-back mechanism linked to the movable housing portion for repositioning the suspension arrangement into a refilling position at a distance from the dispensing position when the movable housing portion is moved from the closed position to the open position.

17 Claims, 8 Drawing Sheets

DISPENSER FOR A ROLL OF ABSORBENT PAPER TISSUE OR NONWOVEN MATERIAL

TECHNICAL FIELD

The present invention relates to a dispenser for paper, tissue or nonwoven material according to the precharacterizing portion of claim 1.

BACKGROUND

Rolls of absorbent paper, tissue or nonwoven material in the form of a web, for e.g. wiping purposes, are often mounted in a dispenser. Absorbent paper, tissue or nonwoven material may be dispensed by a user, from a dispensing end of the absorbent paper, tissue or nonwoven material. The web of absorbent paper, tissue or nonwoven material on the roll may be provided with perforations or may be without perforations.

A dispenser for a roll of absorbent paper, tissue or nonwoven material normally has a housing and the housing is provided with a dispensing opening, through which the web of absorbent paper, tissue or nonwoven material is dispensed. In some types of dispensers it is advantageous to position the roll of absorbent paper, tissue or nonwoven material specifically in relation to the dispensing opening to provide for reliable dispensing of web from the roll of absorbent paper, tissue or nonwoven material.

SUMMARY

An object of the present invention is to provide a dispenser for a roll of absorbent paper, tissue or nonwoven material, which besides storing the roll in a suitable position for dispensing, also provides for easy refilling of the dispenser when the roll has been consumed and a new roll is to be inserted in the dispenser.

According to an aspect of the invention, the object is achieved by a dispenser for a roll of absorbent paper, tissue or nonwoven material with a centre axis and two end surfaces. The dispenser comprises a housing with a first wall provided with a dispensing opening and a movable housing portion. The movable housing portion allows, in an open position, the dispenser to be refilled. The centre axis of the roll is adapted to be arranged substantially parallel to the first wall and each end surface of the roll is adapted to be directed substantially perpendicular to the first wall. The dispenser further comprises a suspension arrangement for the roll and in which the roll is rotatable. The suspension arrangement is arranged to move the roll with the end surfaces substantially perpendicular to the first wall and to bias the roll towards the dispensing opening in a dispensing position when the movable housing portion is in a closed position. The suspension arrangement is connected to a pull-back mechanism linked to the movable housing portion for repositioning the suspension arrangement into a refilling position at a distance from the dispensing position when the movable housing portion is moved from the closed position to the open position.

Since the dispenser comprises a suspension arrangement, which is repositioned into a refilling position from a dispensing position when the movable housing portion is moved from the closed position to the open position, the dispenser is easily refilled with a new roll. As a result, the above mentioned object is achieved.

The dispenser housing is formed by the movable housing portion and one or more further housing portions. The housing, with the exception of the dispensing opening may enclose the roll to protect it from outside influence. The roll may be provided with a core. The dispensing position of the roll of absorbent paper, tissue or nonwoven material is to be interpreted not only as one position but as any position from which web may be dispensed from the roll. The biasing of the roll towards the dispensing opening entails that the centre axis of the roll in the dispensing position is moved towards the dispensing opening as the diameter of the roll is reduced when web is dispensed therefrom. When all web of absorbent paper, tissue or nonwoven material has been dispensed, the centre axis of the roll is in a dispensing position closest to the dispensing opening, i.e. an empty roll position. Biasing of the roll may be active biasing, i.e. biasing by means of a force other than gravity or more than gravity only, e.g. by a spring force. When the movable housing portion is opened in this situation, the empty core, if the roll has any, is moved from the empty roll position to the refilling position from which the empty core is removed and a full roll may be placed in the suspension arrangement.

According to example embodiments the housing may comprise two side walls and the suspension arrangement may be arranged at least one of the side walls.

According to example embodiments the suspension arrangement may comprise at least one pivot arm, which at one end is adapted to receive the roll and at an other end is pivotably connected to the housing for moving between the refilling and dispensing positions. Such a pivot arm may easily be linked to the pull-back mechanism. A pivot arm may easily be biased towards the dispensing opening and may ensure that the roll follows a suitable path towards the dispensing opening.

According to example embodiments the suspension arrangement may comprises a track in the at least one of the two side walls, along which track the roll is adapted to be moved. Such a track may by itself guide or support the roll of absorbent paper, tissue or nonwoven material, or it may be combined with an above-mentioned pivot arm. Again, the track may ensure that the roll follows a suitable path towards the dispensing opening.

According to example embodiments the suspension arrangement may be biased by means of a spring attached to the suspension arrangement and the housing. The biasing towards the dispensing opening may thus be achieved, for instance by the spring being attached to a pivot arm of the suspension arrangement.

According to example embodiments the dispenser may comprise a drive roller arranged in, or at, the dispensing opening and substantially in parallel with the centre axis of the roll of absorbent paper, tissue or nonwoven material. The roll may be biased to abut against the drive roller by means of the suspension arrangement. In this manner the rotation of the drive roller, which may be achieved by a user when dispensing web from the roll, may be transferred to the roll. A controlled dispensing may thus be achieved.

According to example embodiments the drive roller may be adapted to rotate substantially at the same peripheral speed as the roll when paper, tissue or nonwoven material is dispensed. This may be achieved via biasing of the roll against drive roller and a frictional engagement between the drive roller and the roll. Again, a controlled dispensing from the roll may thus be achieved.

According to example embodiments the pull-back mechanism may comprise a pull-back arm or pull-back linkage attached to the suspension arrangement and the movable housing portion. In this manner a pull-back mechanism may easily be provided.

According to example embodiments the pull-back mechanism may comprise a pull-back cord or flexible linkage attached to the suspension arrangement and the movable housing portion. Again, in this manner a pull-back mechanism may easily be provided. An example of a flexible linkage may be a chain.

According to example embodiments the suspension arrangement may comprise a locking arrangement for releasably locking the suspension arrangement in the refilling position. It may thus be ensured that the suspension arrangement remains in the refilling position without being biased towards the dispensing opening and without being placed in the dispensing position for easily taking our an empty core and placing a new full roll in the suspension arrangement and the dispenser.

According to example embodiments the locking arrangement may be releasable by means of an activating arrangement of the roll of absorbent paper, tissue or nonwoven material. A new roll placed in the suspension arrangement may thus release the locking arrangement and the suspension arrangement may be biased towards the dispensing opening and be placed in the dispensing position.

According to example embodiments the activating arrangement may comprise a flange arranged on a core of the roll of absorbent paper, tissue or nonwoven material. This is understood to encompass a flange arrange at a centre of a coreless roll.

According to example embodiments the dispenser may comprise a second suspension arrangement at an other of the two side walls. The second suspension arrangement may comprise features as mentioned in relation to the suspension arrangement mentioned in the above example embodiments. Accordingly, the suspension arrangement may be formed by the same elements and have the same functions at both side walls, or the suspension arrangement may comprise, at the said other of the two side walls, only some of the elements present at the said one of the two side walls.

According to example embodiments the suspension arrangement at the said one of the two side walls may be differently shaped for receiving an end portion of the roll of absorbent paper, tissue or nonwoven material than the second suspension arrangement is shaped for receiving an end portion of the roll at the said other of the two side walls. In this manner it may be ensured that a roll of absorbent paper, tissue or nonwoven material is always placed in the right direction in the dispenser, i.e. such that the roll will always rotate in a given direction.

According to example embodiments the differently shaped suspension arrangements at the two side walls may comprise differently sized slots adapted to receive correspondingly differently sized end portions of the roll. Such end portions may be inserts placed in a core of the roll, in a centre of a coreless roll, or may form part of the core of the roll.

According to example embodiments the movable housing portion may be an upper housing portion. The upper housing portion in the open position may provide access from above to an inside of the dispenser. Thus, according to further example embodiments the suspension arrangement in the refilling position may be arranged to receive a roll from above when refilling the dispenser.

According to example embodiments the dispenser may be a portable dispenser.

Further features of, and advantages with, the present invention will become apparent when studying the appended claims and the following description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

Well-known functions or constructions may not be described in detail for brevity and/or clarity.

Figure 1:
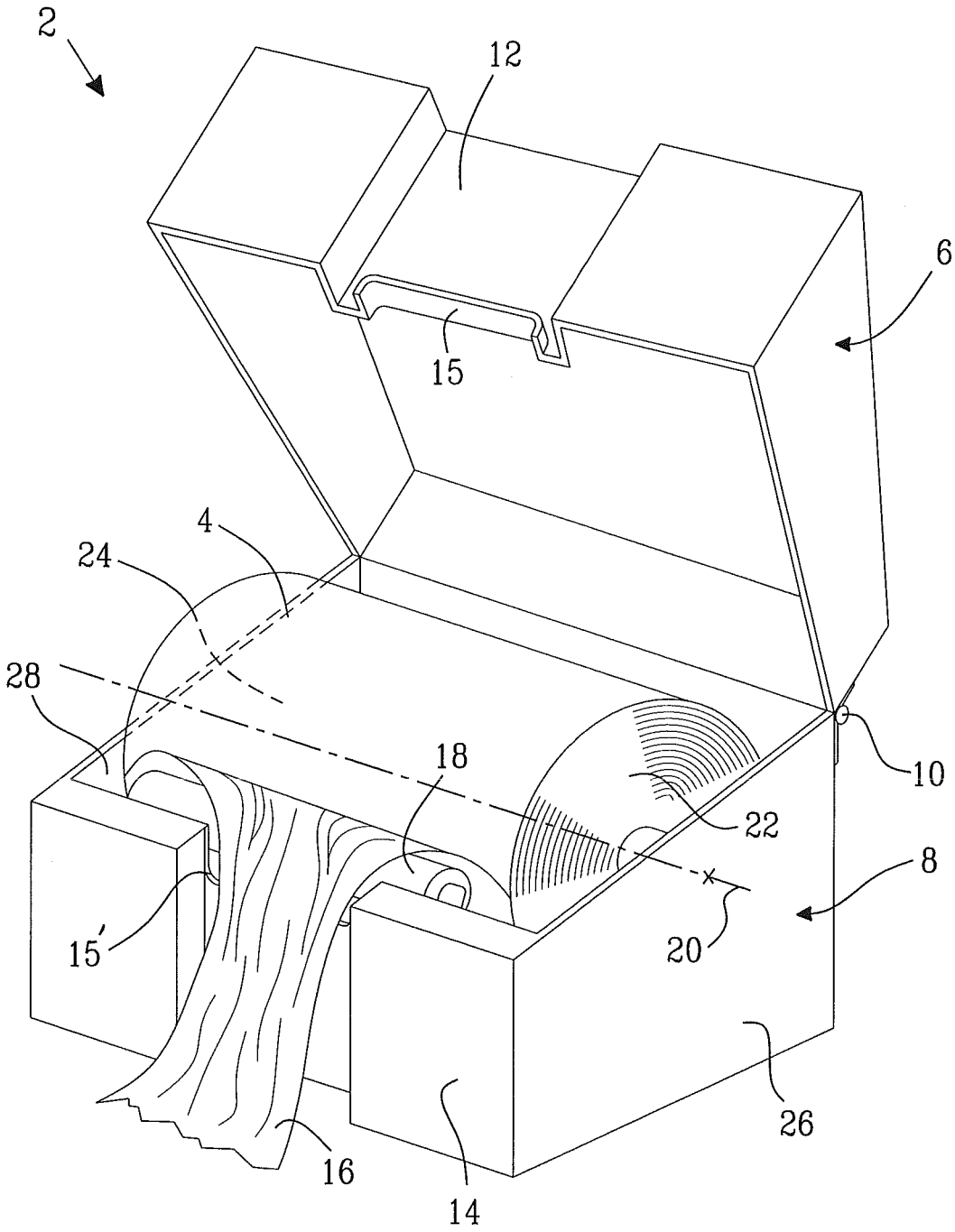
FIG. 1 illustrates schematically a dispenser for a roll of paper, tissue or nonwoven material according to example embodiments.

FIG. 1 illustrates schematically a dispenser 2 for a roll 4 of paper, tissue or nonwoven material according to example embodiments. In the following the term roll will be used for the roll of paper, tissue or nonwoven material. The paper, tissue or nonwoven material is in the form of a perforated or non-perforated web, in the following referred to as web. The dispenser 2 is portable and may be provided with a not-shown handle to facilitate carrying or suspending the dispenser 2. The dispenser 2 comprises a movable housing portion 6 in the form of an upper housing portion, and a lower housing portion 8 which is adapted to be placed on a surface. The movable housing portion 6 extends from an upper portion downwards to form side surfaces of the dispenser 2. The lower housing portion 8 may form a trough such that liquid cannot enter the dispenser 2 from below. The housing portions 6, 8 are connected to each other at one end by means of a hinge 10 and the movable housing portion 6 is illustrated in an open position. Opposite to the first hinge 10 there is formed a dispensing opening for the web between the upper and lower housing portions 6, 8 when the movable housing portion 6 is in a closed position. The dispensing opening is formed in a first wall of the dispenser 2, which first wall is formed by first and second wall sections 12, 14, the first wall section 12 forming part of the movable housing portion 6 and the second wall section 14 forming part of the lower housing portion 8. A recess 15, 15' in each of the first and second wall sections 12, 14 forms the dispensing opening.

In the open position, an empty roll 4 in the dispenser 2 may be replaced with a new roll 4. The roll 4 is rotatably arranged inside the dispenser 2. A free end 16 of the web extends out from the dispenser 2 at the recess 15' forming part of the dispensing opening when the housing portions 6, 8 are in the closed position. Upstream of the dispensing direction from the free end 16, the web passes over a drive roller 18 arranged in, or at, the dispensing opening. The roll 4 is arranged to abut the drive roller 18. The roll 4 and the drive roller 18 are frictionally engaged. Since the web leading from the roll 4 to the free end 16 passes over the drive roller 18, and when web is dispensed from the roll 4, the drive roller 18 is rotated by the dispensed end of the web passing over the drive roller 18. Due to the frictional engagement, the roll 4 is rotated by the drive roller 18.

A centre axis 20 of the roll 4 is arranged substantially parallel to the first wall and end surfaces 22, 24 of the roll 4 are arranged substantially perpendicular to the first wall. The dispenser 2 is provided with a not-shown suspension arrangement for the roll 4. The suspension arrangement is arranged at side walls 26, 28 of the dispenser 2. The roll 4 is suspended in the suspension arrangement such that roll 4 therein can be rotated about the centre axis 20. The suspension arrangement has a dispensing position, in which the roll 4 is biased towards the dispensing opening and abuts the drive roller 18. The suspension arrangement thus allows the roll 4 to be moved perpendicularly to the first wall. The suspension arrangement further has a refilling position in which an empty roll 4 may be replaced.

FIGS. 2*a*-2*f* illustrate a suspension arrangement 30 of a schematically shown dispenser 2 according to example embodiments. In FIGS. 2*a*-2*f* a sequence is illustrated, in which a movable housing portion 6 of the dispenser 2 is moved from an open position to a closed position and back again to the open position. In the sequence it is also illustrated how the suspension arrangement 30 is moved from a refilling position to a dispensing position and back again. The movable housing portion 6 is connected to a lower housing portion 8 of the dispenser 2 by means of a hinge 10.

The suspension arrangement 30 comprises a pivot arm 32 which at a first end 34 is pivotably connected to the lower housing portion 8. At a second end 36, the pivot arm 32 is provided with a seat 38 for receiving an axle, axle end or similar of a not-shown roll of paper, tissue or nonwoven material. In the seat 38 the roll can be rotated about its centre axis. The suspension arrangement 30 further comprises a pull-back mechanism comprising a pull-back arm 40. The pull-back arm 40 is at a first end provided with a slot 42 in which a pin 44 of the pivot arm 42 is slidably supported. At a pivot end 46 the pull-back arm 40 is pivotably connected to the movable housing portion 6. Due to the pivotably connected pivot end 46 being arranged at a distance from the hinge 10, a lever is formed in the movable housing portion 6 between the pivot end 46 and the hinge 10.

Figure 2A:
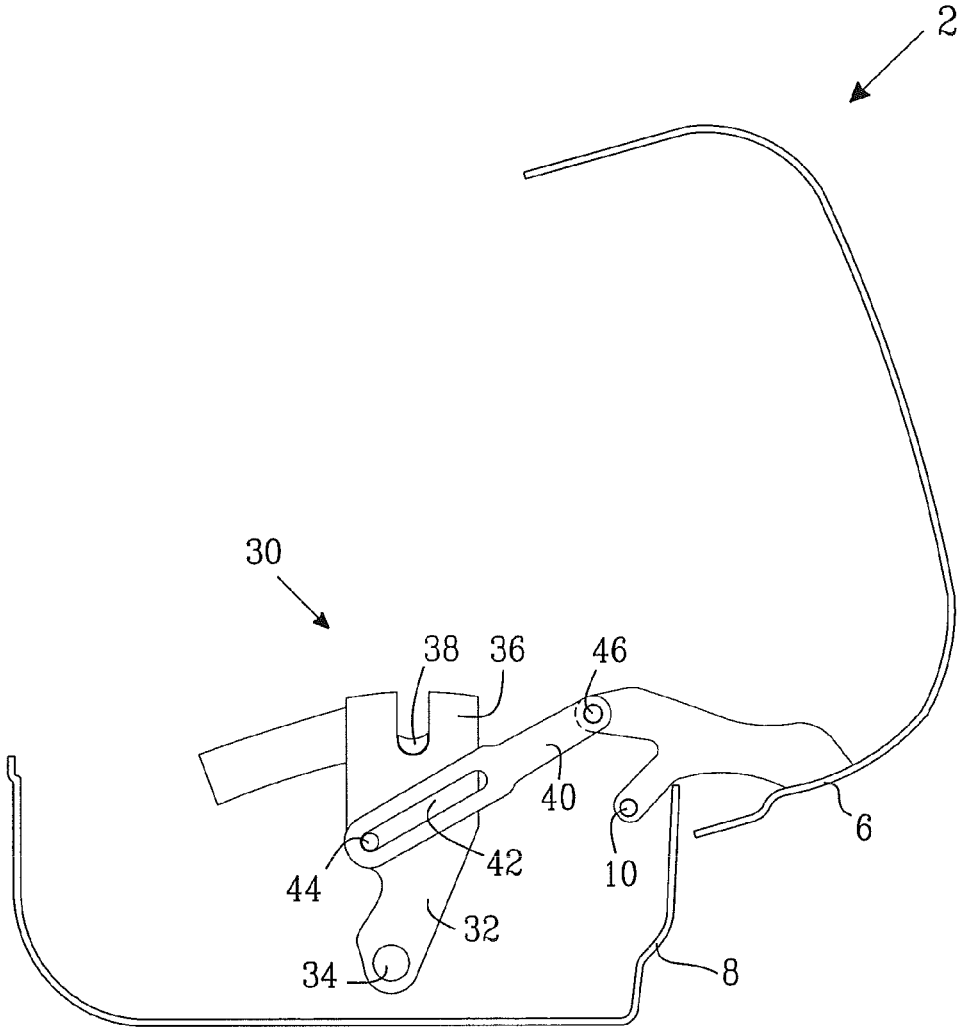
FIGS. 2*a*-2*f* illustrate a suspension arrangement of a schematically shown dispenser according to example embodiments.

In FIG. 2*a* the movable housing portion 6 is shown in the open position with the suspension arrangement 30 in the refilling position. An empty roll may be taken out of the dispenser 2 and a new roll may be placed in the dispenser 2 from above, more specifically in the seat 38 of the pivot arm 32.

Figure 2B:
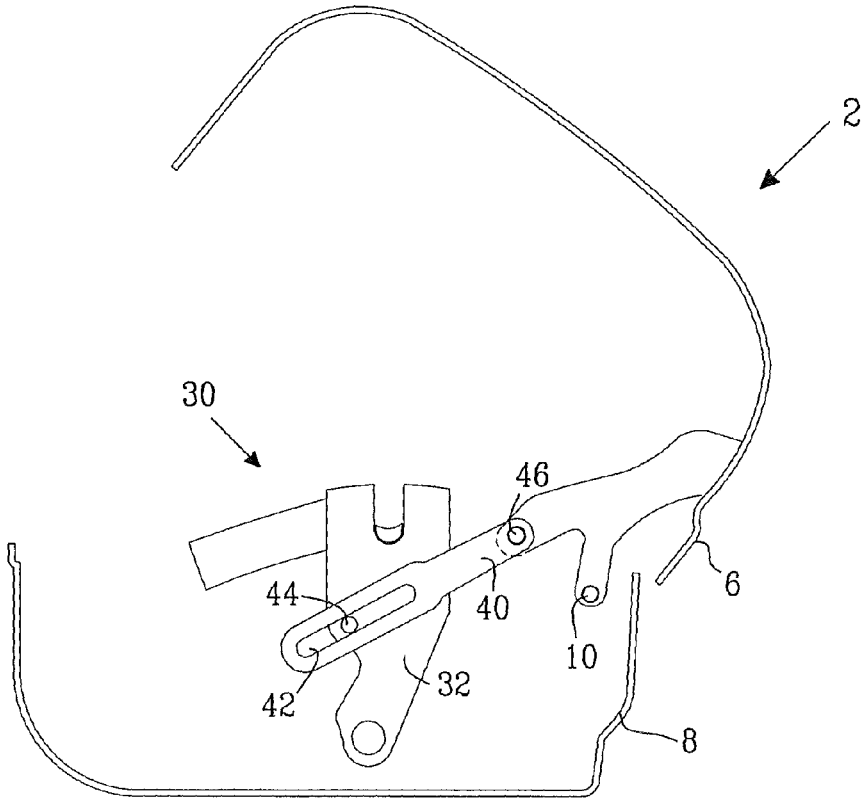

In FIG. 2*b* the movable housing portion 6 is pivoted about the hinge 10 towards the closed position. The pull-back arm 40 slides in its slot 42 along the pin 44 on the pivot arm 32.

Figure 2C:
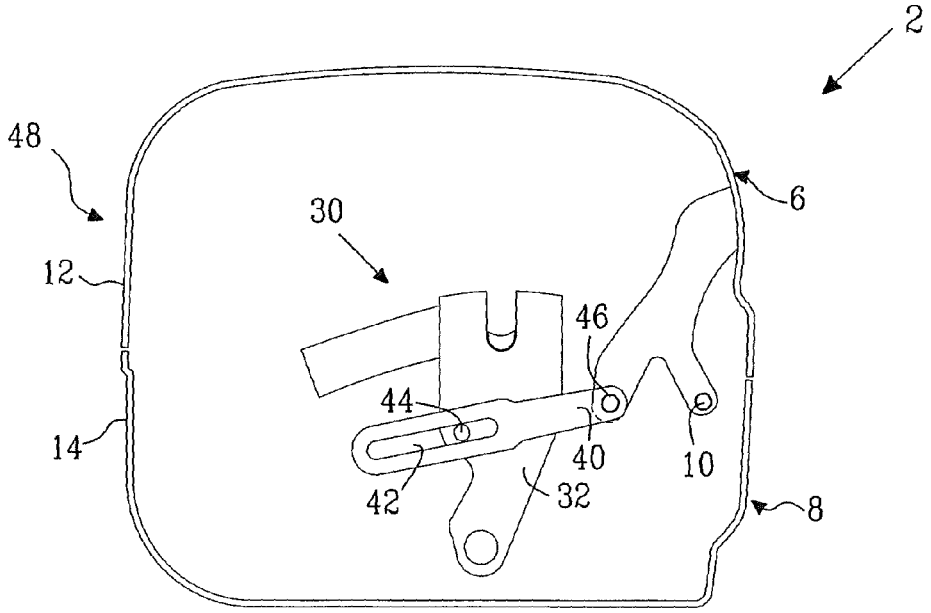

In FIG. 2*c* the movable housing portion 6 has reached the closed position. The suspension arrangement 30 is in the dispensing position in which the pivot arm 32 is biased towards a not-shown dispensing opening in a first wall 48 of the dispenser 2. The pivot arm 32 is biased by means of a not-shown torsion spring arranged between the first end 34 of the pivot arm and the lower housing portion 8. The first wall 48 comprises a first wall section 12 of the movable housing portion 6 and a second wall section 14 of the lower housing portion 8.

Figure 2D:
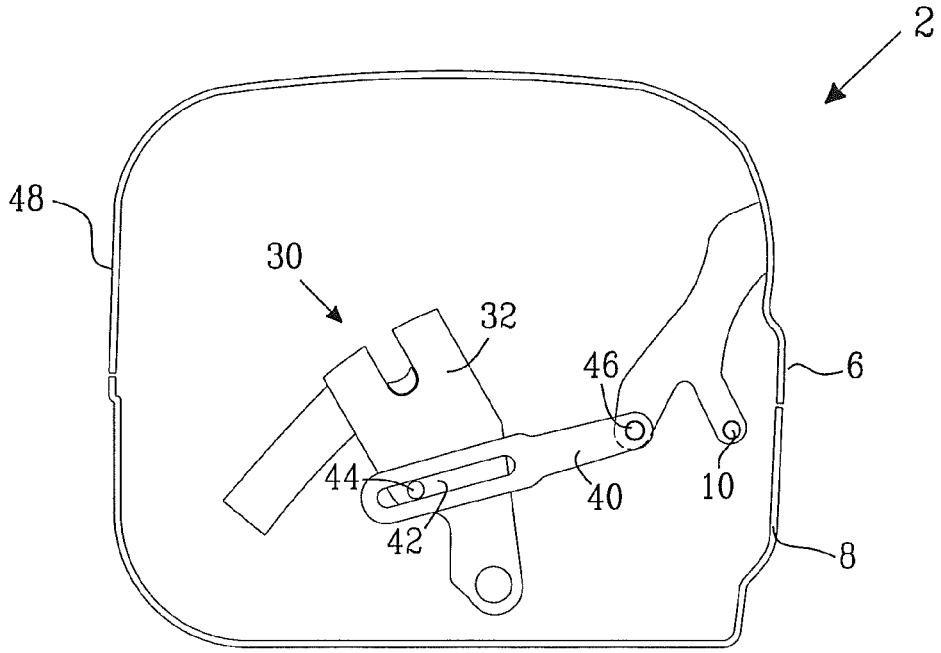

In FIG. 2*d* the dispenser 2 is shown with the movable housing portion 6 in the closed position. The suspension arrangement 30 is in the dispensing position. The pivot arm 32, being biased towards the first wall 48, has reached a position more than halfway towards an end position. This position corresponds to a position which the pivot arm 32 occupies when about half of the web from the not-shown roll has been dispensed therefrom. During dispensing, the pin 44 in the pivot arm 32 slides along the slot 42 in the pull-back arm 40.

Figure 2E:
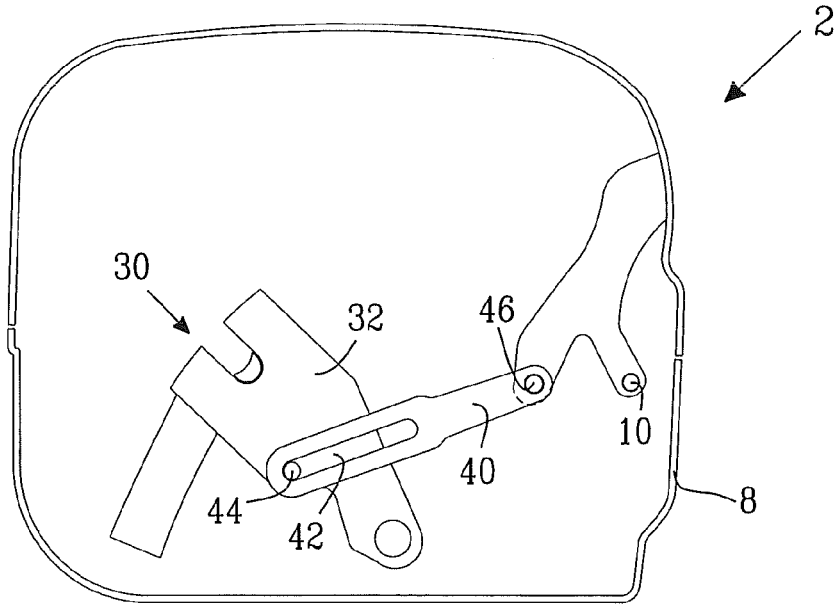

In FIG. 2*e* the suspension arrangement 30 is in the dispensing position as the pivot arm 32 has reached an end position. The end position, or empty roll position, corresponds to a position which the pivot arm 32 occupies when all web has been dispensed from the not-shown roll. The pin 44 on the pivot arm 32 has slid all the way to an end of the slot 42 in the pull-back arm 40.

Figure 2F:
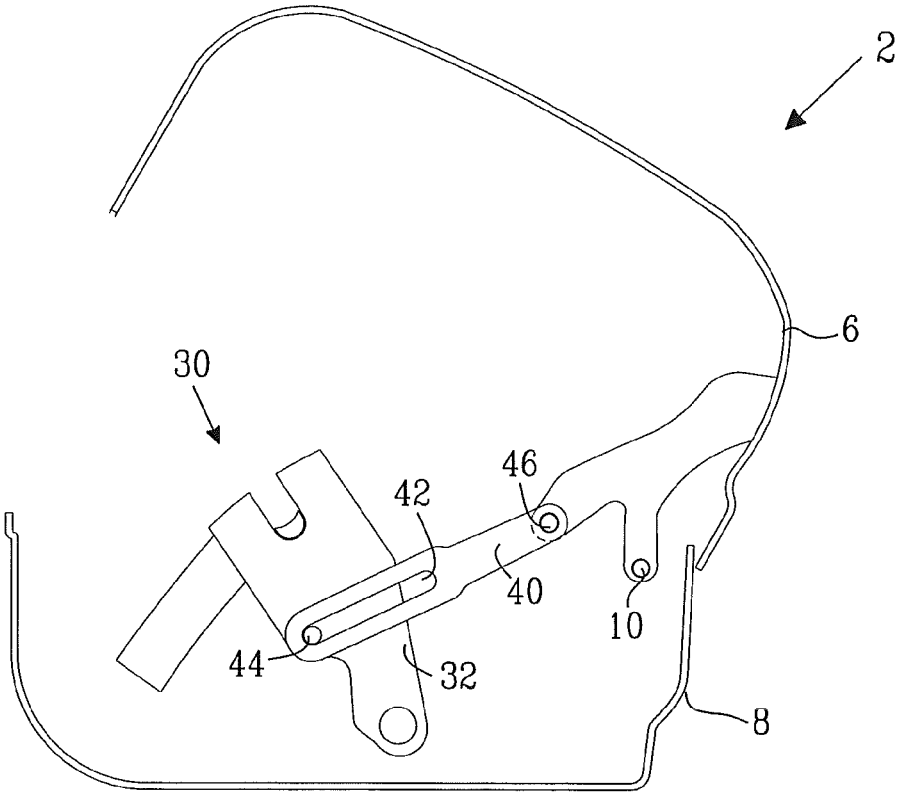

In FIG. 2*f* the movable housing portion 6 is being opened, i.e. moved from the closed position towards the open position. The suspension arrangement 30 is moved from the dispensing position towards the refilling position since the pivot arm 32 is pulled by means of the pull-back arm 40 as the pin 44 of the pivot arm 32 abuts an end surface of the slot 42. The pivot arm 32 is pulled against the biasing force of the not-shown torsion spring. When the movable housing portion 6 is fully open the dispenser 2 is again in the position illustrated in FIG. 2*a*, ready for removal of an empty roll and thereafter, to be refilled.

Figure 3A:
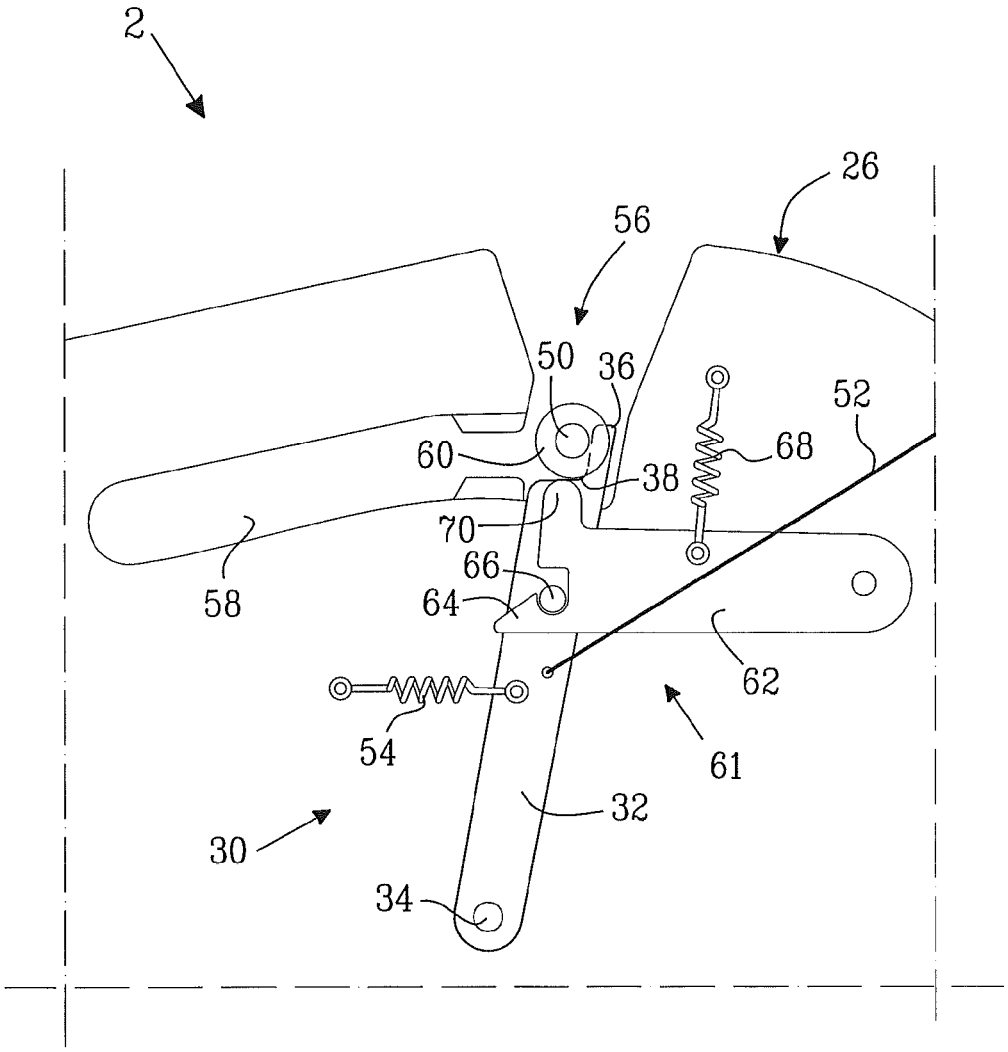
FIGS. 3*a*-3*c* illustrate a suspension arrangement and a cross section through a portion of a schematically shown dispenser according to example embodiments.
Figure 3B:
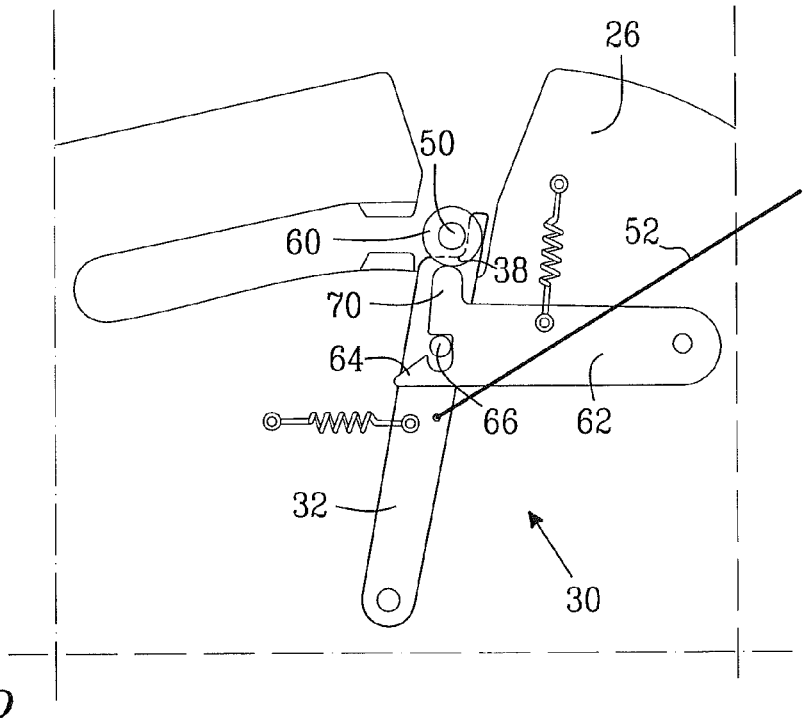
Figure 3C:
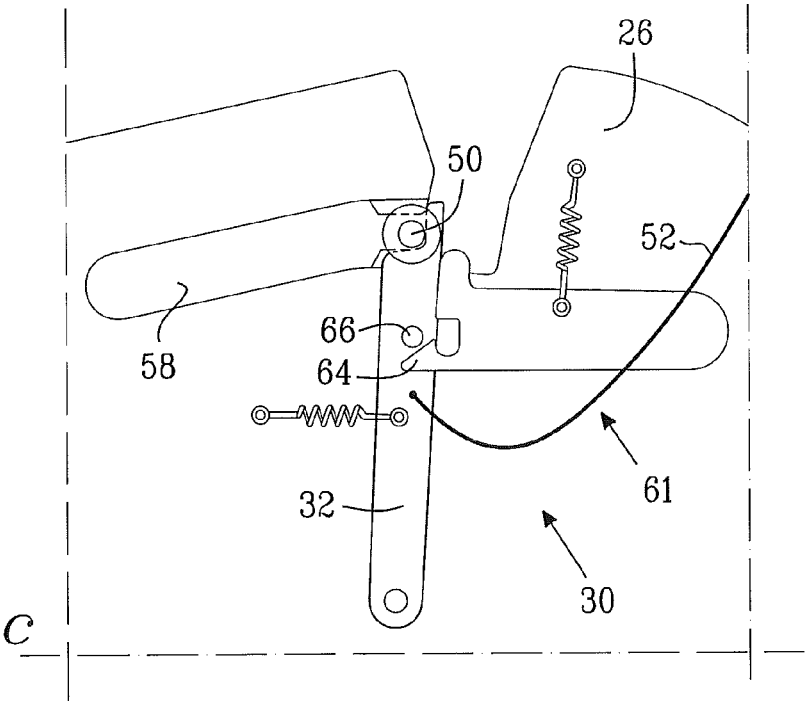

FIGS. 3*a*-3*c* illustrate a suspension arrangement 30 and a cross section through a portion of a schematically shown dispenser 2 according to example embodiments. In FIGS. 3*a*-3*c* a sequence is illustrated in which the suspension arrangement 30 is moved from a refilling position to a dispensing position. The suspension arrangement 30 comprises a pivot arm 32, which arm 32 at a first end 34 is pivotably connected to a side wall 26 of the dispenser 2. At its other end 36, the pivot arm 32 is provided with a seat 38 for an axle end 50 of a roll of paper, tissue or nonwoven material. The axle end 50 may form at least part of a core, it may be a separate insert to be inserted into a core of a roll or in a centre of a coreless roll, or it may be part of a separate axle insertable in a core or centre of the roll. The roll itself is not shown in the FIGS. 3*a*-3*c*. A pull-back mechanism in the form of a pull-back cord 52 is connected to the pivot arm 32 and to a not-shown movable housing portion of the dispenser 2. The pull-back mechanism may alternatively be a flexible linkage such as a chain 52. A tension spring 54 is connected to the pivot arm 32 and the housing of the dispenser 2 to bias the pivot arm towards a not-shown first wall with a dispensing opening of the dispenser 2. The side wall 26 is provided with a slot 56 for placing the axle end 50 of a roll in the seat 38 on the pivot arm 32. The side wall is further provided with a track 58 in which the axle end 50 of the roll is guided when in a dispensing position. The slot 56 and the track 58 may be seen to form part of the suspension arrangement 30.

The suspension arrangement 30 comprises a locking arrangement 61 for releasably locking the suspension arrangement 30 in the refilling position. The locking arrangement 61 comprises a locking arm 62 with an engaging hook 64 adapted to engage with a locking pin 66 arranged on the pivot arm 32. The locking arm 62 is biased upwardly by means of a spring 68 connected to the locking arm 62 and the side wall 26.

In FIG. 3*a* the suspension arrangement 30 is in the refilling position and a roll is to be placed in the dispenser 2. The pivot arm 32 has been pulled by the pull-back cord 52 when the not-shown movable housing portion was moved to an open position. The pivot arm 32 is positioned in its farthest clockwise direction. In this position the pivot arm 32 is locked by the engaging hook 64 of the locking arm 62 engaging with the pin 66 of the pivot arm. The axle end 50 of the roll is about to make contact with the seat 38 of the pivot arm 32. A flange 60 at an end of the axle end 50 is about to depresses a protrusion 70 of the locking arm 62. The flange 60 forms an activating arrangement of the roll.

In FIG. 3*b* axle end 50 of the roll has made contact with the seat 38 of the pivot arm 32. The flange 60 of the axle end 50 has depressed the protrusion 70 and the locking arm 62 such that the engaging hook 64 releases the pin 66 of the pivot arm 32. The weight of a full roll of paper, tissue or nonwoven material should be enough to depress the locking arm 62. The pull-back cord 52 is still pulled tight by the not-shown open movable housing portion.

In FIG. 3*c* the not-shown movable housing portion has been moved into a closed position. Accordingly the pull-back cord 52 is now slack. The tension spring 54 has biased the pivot arm 32 of the suspension arrangement 30 towards the not shown dispensing opening of the housing. The axle end 50 of the not-shown roll has been urged into the track 58 in the side wall 26. The suspension arrangement 30 is thus in the dispensing position. The locking arrangement 61 is ready to lock the pivot arm 32 in the refilling position, should the movable housing portion again be opened such that the pull-back cord 52 pulls at the pivot arm 32.

Figure 4A:
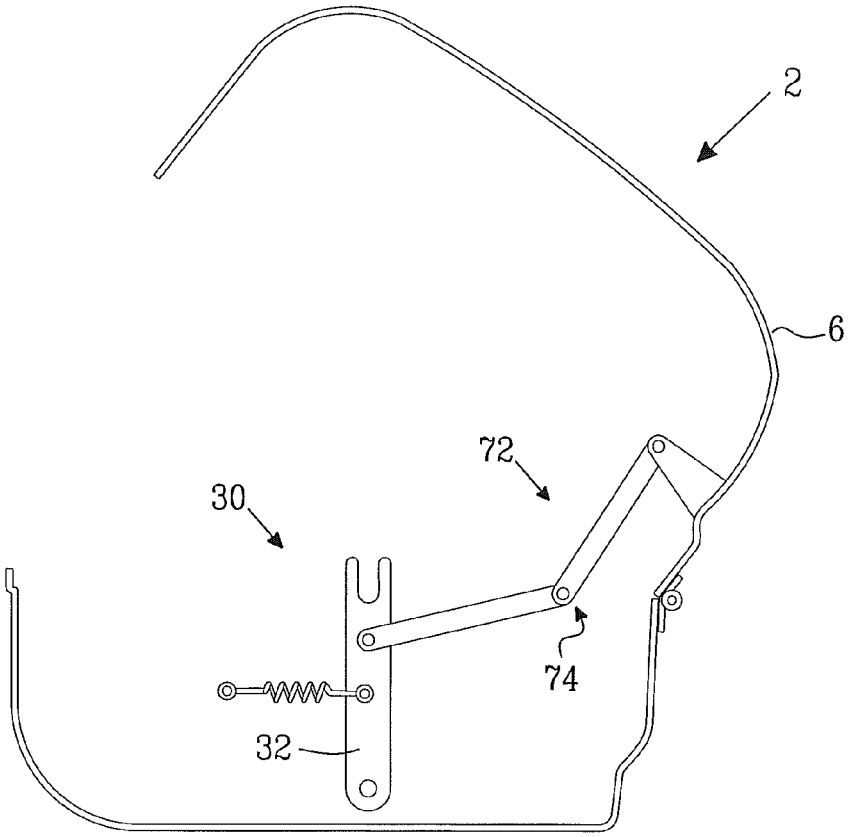
FIGS. 4*a* and 4*b* illustrate schematically an alternative pull-back mechanism comprising a pull-back linkage.
Figure 4B:
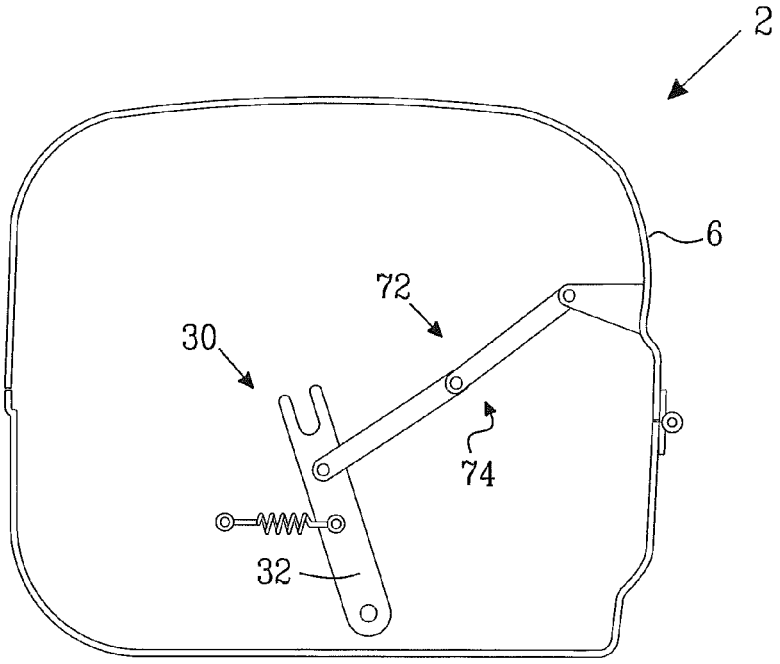

FIGS. 4*a* and 4*b* illustrate schematically an alternative pull-back mechanism comprising a pull-back linkage 72 in the form of a two-arm linkage 74 connected to a movable housing portion 6 of a dispenser 2 and a pivot arm 32 of a suspension arrangement 30. In FIG. 4*a* the movable housing portion 6 is in an open position and the two-arm linkage 74 is fully extended. The pivot arm 32 has been moved fully clockwise such that the suspension arrangement 30 is in a refilling position. In FIG. 4*b* the movable housing portion 6 is in a closed position and the two-arm linkage 74 is folded to allow the pivot arm 32 to move towards a not-shown dispensing opening of the dispenser 2. The suspension arrangement 30 is in a dispensing position.

Example embodiments may be combined as understood by a person skilled in the art. It is also understood by those skilled in the art that the a dispenser according to example embodiments may be provided with a second suspension arrangement in the form illustrated in FIGS. 2*a*-2*f* and FIGS. 3*a*-3*c* at an opposite side wall of the dispenser. The second suspension arrangement may be said to form part of the suspension arrangement for the roll of paper, tissue or nonwoven material. It is also envisaged that the suspension arrangement at an opposite wall comprise a more simple construction, e.g. in the form of a track along which an axle or axle or axle end of the roll may be guided.

With reference to FIG. 3*a*, an embodiment in which it is ensured that a roll of paper, tissue or nonwoven material is placed to rotate in the correct direction in the dispenser 2, may be designed such that the two side walls of the dispenser 2 are provided with differently wide slots 56 and the axle end 50 of the roll is provided with different diameter flanges 60 at its two ends. Thus, the roll may only fit in one direction in the dispenser 2, i.e. the larger diameter flange 60 will only fit in the wider slot 56.

Although the invention has been described with reference to example embodiments, many different alterations, modifications and the like will become apparent for those skilled in the art.

Therefore, it is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present.

The invention claimed is:

1. A dispenser for a roll of absorbent paper, tissue or nonwoven material with a centre axis and two end surfaces, said dispenser comprising a housing with a first wall provided with a dispensing opening and a movable housing portion, which movable housing portion in an open position allows said dispenser to be refilled, wherein said centre axis of said roll is adapted to be arranged substantially parallel to said first wall and each end surface of said roll is adapted to be directed substantially perpendicular to said first wall, said dispenser further comprising a suspension arrangement for said roll and in which said roll is rotatable, said suspension arrangement being arranged to move said roll with said end surfaces substantially perpendicular to said first wall and to bias said roll towards said dispensing opening in a dispensing position when said movable housing portion is in a closed position, and wherein said suspension arrangement is connected to a pull-back mechanism linked to said movable housing portion for repositioning said suspension arrangement into a refilling position at a distance from said dispensing position when said movable housing portion is moved from said closed position to said open position.

2. The dispenser according to claim 1, wherein said housing comprises two side walls and said suspension arrangement is arranged at at least one of said side walls.

3. The dispenser according to claim 2, wherein said suspension arrangement comprises a track in said at least one of said two side walls, along which track said roll is adapted to be moved.

4. The dispenser according to claim 2, wherein said dispenser comprises a second suspension arrangement at an other of said two side walls.

5. The dispenser according to claim 4, wherein said suspension arrangement at said one of said two side walls is differently shaped for receiving an end portion of said roll than said second suspension arrangement is shaped for receiving an end portion of said roll at said other of said two side walls.

6. The dispenser according to claim 5, wherein said differently shaped suspension arrangements at said two side walls comprise differently sized slots adapted to receive correspondingly differently sized end portions of said roll.

7. The dispenser according to claim 1, wherein said suspension arrangement comprises at least one pivot arm, which at one end is adapted to receive said roll and at an other end is pivotably connected to said housing for moving between said refilling and dispensing positions.

8. The dispenser according to claim 1, wherein said suspension arrangement is biased by means of a spring attached to said suspension arrangement and said housing.

9. The dispenser according to claim 1, wherein said dispenser comprises a drive roller arranged in, or at, said dispensing opening and substantially in parallel with said centre axis of said roll and said roll is biased to abut against said drive roller by means of said suspension arrangement.

10. The dispenser according to claim 1, wherein said pull-back mechanism comprises a pull-back arm or pull-back linkage attached to said suspension arrangement and said movable housing portion.

11. The dispenser according to claim 1, wherein said pull-back mechanism comprises a pull-back cord or flexible linkage attached to said suspension arrangement and said movable housing portion.

12. The dispenser according to claim 1, wherein said suspension arrangement comprises a locking arrangement for releasably locking said suspension arrangement in said refilling position.

13. The dispenser according to claim 12, wherein said locking arrangement is releasable by means of an activating arrangement of said roll.

14. The dispenser according to claim 13, wherein said activating arrangement comprises a flange arranged on a core of said roll.

15. The dispenser according to claim 1, wherein said movable housing portion is an upper housing portion, said upper housing portion in said open position providing access from above to an inside of said dispenser.

16. The dispenser according to claim 15, wherein said suspension arrangement in said refilling position is arranged to receive a roll from above when refilling said dispenser.

17. The dispenser according to claim 1, wherein said dispenser is a portable dispenser.

* * * * *